US010876762B2

(12) United States Patent
Jeong et al.

(10) Patent No.: US 10,876,762 B2
(45) Date of Patent: Dec. 29, 2020

(54) HEAT EXCHANGER

(71) Applicant: KYUNGDONG NAVIEN CO., LTD., Pyeongtaek-si (KR)

(72) Inventors: Inchul Jeong, Seoul (KR); Jung Yul Bae, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 251 days.

(21) Appl. No.: 16/072,370

(22) PCT Filed: Feb. 3, 2017

(86) PCT No.: PCT/KR2017/001185

§ 371 (c)(1),
(2) Date: Jul. 24, 2018

(87) PCT Pub. No.: WO2017/135729

PCT Pub. Date: Aug. 10, 2017

(65) Prior Publication Data

US 2019/0032956 A1 Jan. 31, 2019

(30) Foreign Application Priority Data

Feb. 5, 2016 (KR) ..... 10-2016-0015067

(51) Int. Cl.
*F24H 1/34* (2006.01)
*F28F 3/00* (2006.01)
(Continued)

(52) U.S. Cl.
CPC ..... *F24H 1/34* (2013.01); *F24H 1/40* (2013.01); *F24H 9/00* (2013.01); *F24H 9/0026* (2013.01);
(Continued)

(58) Field of Classification Search
CPC ..... F24H 1/30; F24H 1/32; F24H 1/34; F24H 1/40; F24H 9/00; F24H 9/0015;
(Continued)

(56) References Cited

U.S. PATENT DOCUMENTS

2005/0082049 A1* 4/2005 Brost ..... F28D 9/005 165/166
2016/0377319 A1* 12/2016 Kim ..... F28D 9/0043 122/18.31

FOREIGN PATENT DOCUMENTS

JP 2002-107071 A 4/2002
JP 2006-214628 A 8/2006
(Continued)

OTHER PUBLICATIONS

International Search Report dated May 12, 2017, issued to International Application No. PCT/KR2017/001185.

*Primary Examiner* — Edward F Landrum
*Assistant Examiner* — Chang H Park
(74) *Attorney, Agent, or Firm* — Stein IP, LLC

(57) ABSTRACT

The present subject matter includes: heating medium channels, in the space in between a pair of plates facing each other, through which the heating medium flows; combustion gas channels, on the outer sides of the heating medium channels, through which combustion gas burned in a burner flows; and heating medium dispersion parts, having an opening part and a shutting part, on an inlet, through which the heating medium flows into the heating medium channel, and an outlet, through which the heating medium flows out from the heating medium channel.

11 Claims, 11 Drawing Sheets

(51) Int. Cl.
*F24H 9/00* (2006.01)
*F28D 9/00* (2006.01)
*F24H 1/40* (2006.01)

(52) U.S. Cl.
CPC ..... *F28D 9/00* (2013.01); *F28D 9/0006* (2013.01); *F28F 3/00* (2013.01)

(58) Field of Classification Search
CPC .. F24H 9/0026; F28D 2021/0024; F28D 9/00; F28D 9/0006; F28D 9/0043; F28D 1/0375; F28D 3/04; F28F 3/00; F28F 3/042; F28F 9/026; F28F 9/0265
USPC ..... 165/167
See application file for complete search history.

(56) References Cited

FOREIGN PATENT DOCUMENTS

| | | | | | |
|---|---|---|---|---|---|
| KR | 10-1996-0024209 | A | | 7/1996 | |
| KR | 10-2010-0025153 | A | | 3/2010 | |
| KR | 10-2015-0108450 | A | | 9/2015 | |
| KR | 20150108540 | A | * | 9/2015 | ..... F24H 1/30 |
| KR | 10-2015-0108959 | A | | 10/2015 | |

* cited by examiner

[FIG. 9]
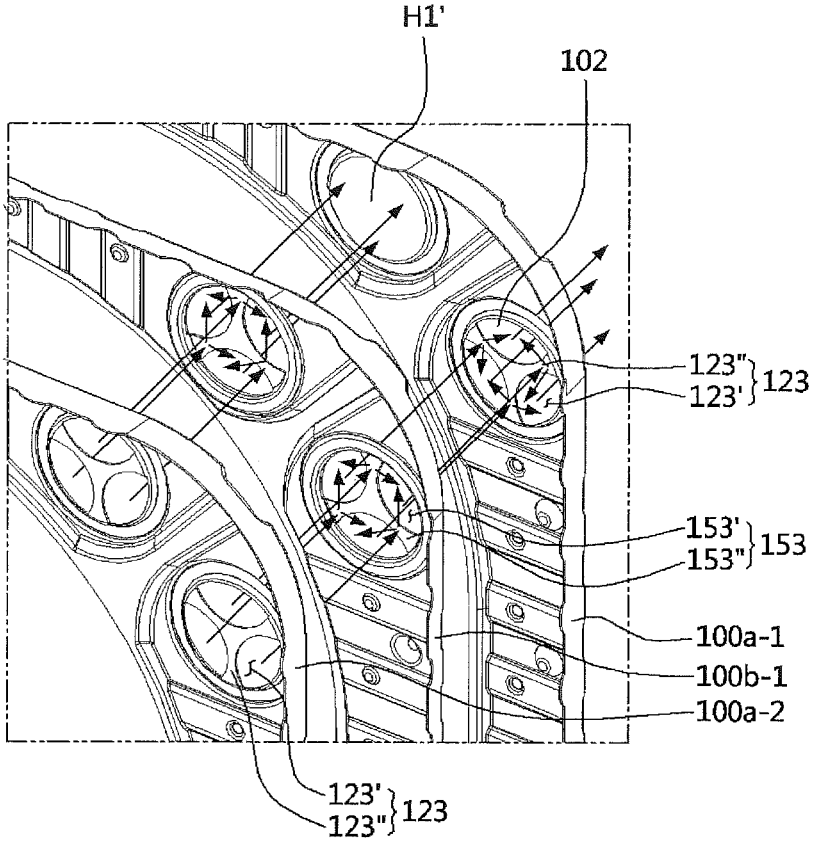

[FIG. 10]
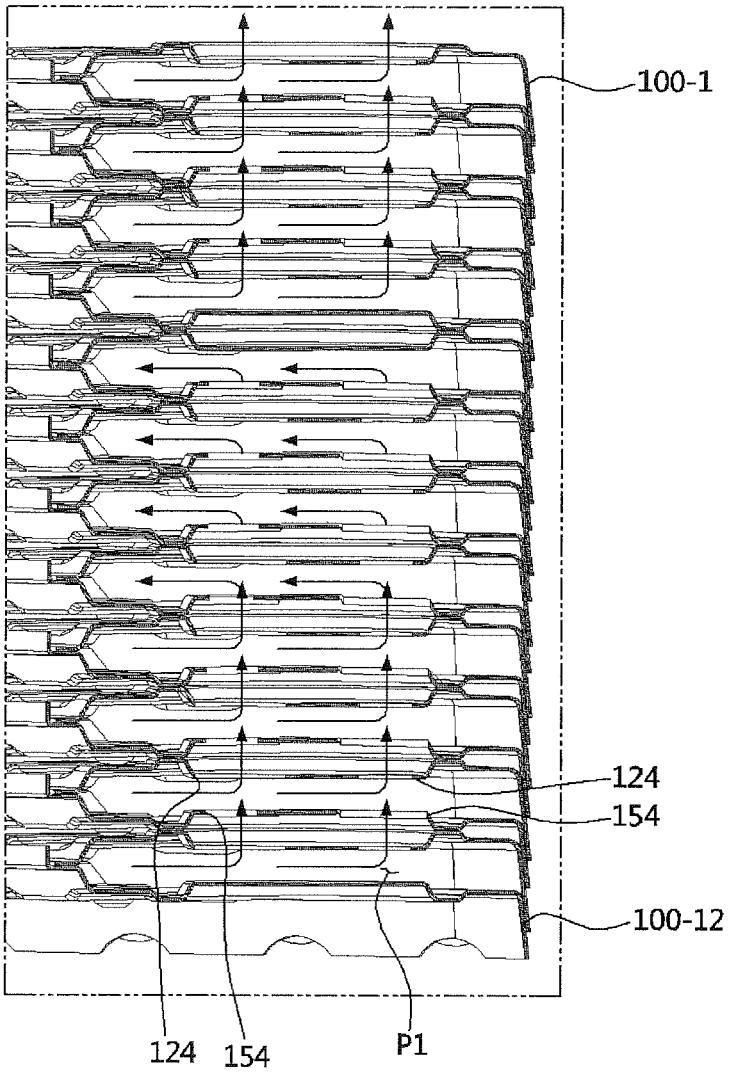

[FIG. 11]
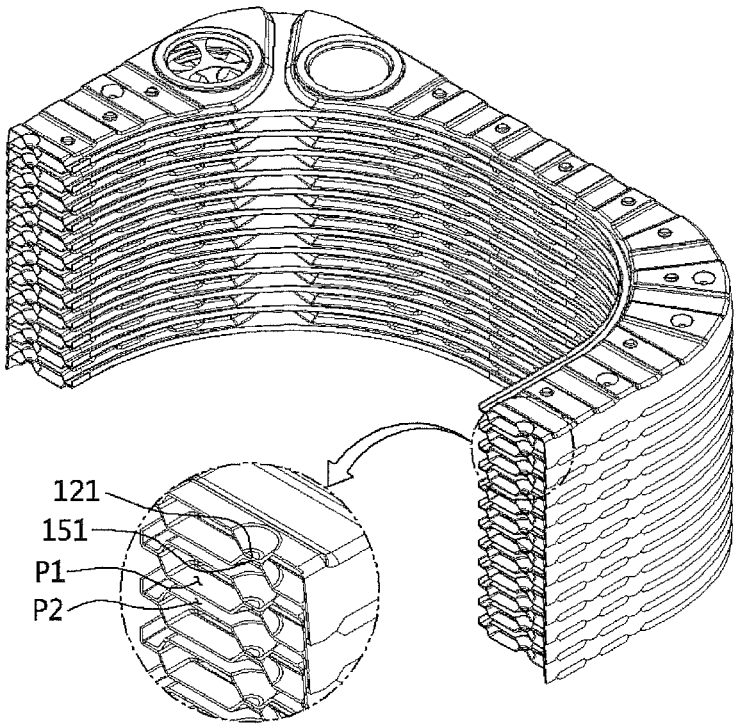
[FIG. 12]
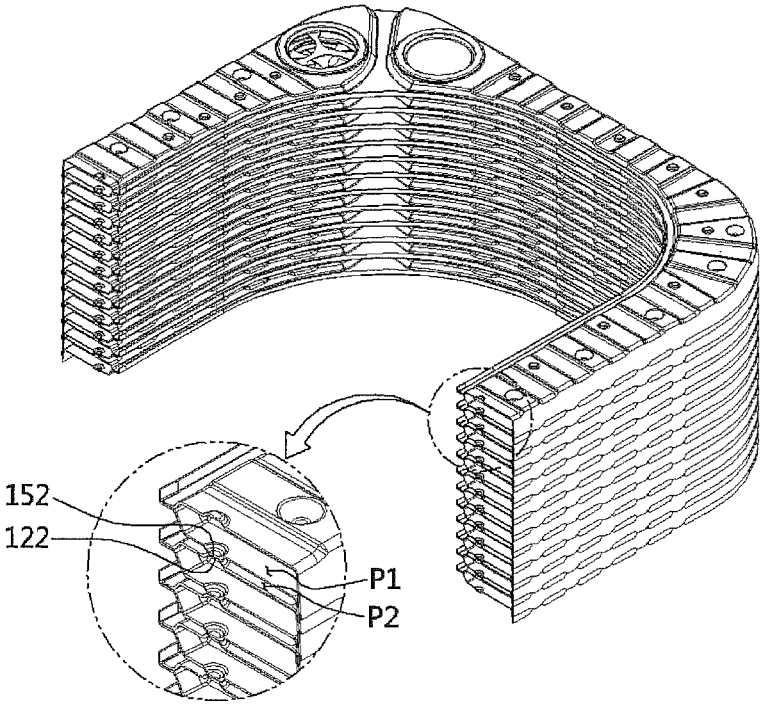

HEAT EXCHANGER

CROSS-REFERENCE TO RELATED APPLICATIONS

This application is a national stage of International Application No. PCT/KR2017/001185, filed Feb. 3, 2017, which claims the benefit of priority to Korean Application No. 10-2016-0015067, filed Feb. 5, 2016, in the Korean Intellectual Property Office, the disclosure of which is incorporated herein by reference.

TECHNICAL FIELD

The present invention relates to a heat exchanger, and more particularly, to a heat exchanger capable of improving heat exchange efficiency by allowing a flow rate of a heating medium passing through heating medium channels, which are formed in multiple layers between a plurality of plates, to be evenly distributed.

BACKGROUND ART

A boiler used for providing heating or hot water is a device configured to heat a desired site or supply hot water by heating tap water or heating water (hereinafter referred to as a "heating medium") with a heat source, wherein the boiler includes a burner configured to burn a mixture of a gas and air, and a heat exchanger configured to transfer combustion heat of a combustion gas to a heating medium.

As an example of a related art relating to a conventional heat exchanger, Korean Registered Patent No. 10-0813807 discloses a heat exchanger including a burner disposed at a central portion of the heat exchanger, and a heat exchange tube wound around a circumference of the burner in the form of a coil.

The heat exchanger disclosed in the above-described Patent Document has problems in that, since the heat exchange tube is formed in a flat shape, the heat exchange tube is deformed into a rounded shape when a pressure is applied to a heat transfer medium portion, and since the heat exchange tube is formed to be rolled up, a thickness of the heat transfer medium portion becomes thicker.

Further, since the conventional heat exchanger has a structure in which the heat exchange tube is wound around a combustion chamber in the form of a coil, heat exchange between the combustion gas and a heating medium is performed only in a local space around the heat exchanger formed in the form of a coil, such that there is a disadvantage in that a heat transfer area cannot be widely secured.

In order to resolve such a problem, a plate-shaped heat exchanger has recently been developed in which a plurality of plates are stacked and thus a heating medium channel and a combustion gas channel are formed in the plurality of stacked plates, such that heat exchange between a heating medium and a combustion gas is performed.

A related art relating to the above-described plate-shaped heat exchanger is disclosed in Japanese Patent Application Publication No. 2006-214628. In the case of the plate-shaped heat exchanger disclosed in the above-described Patent Document, while a heating medium is distributed to flow to heating medium channels formed in a plurality of layers, a flow direction of the heating medium may be changed from a horizontal direction to a vertical direction, and a flow rate of the heating medium distributed to each of the plurality of layers may be unevenly distributed due to inertia and a pressure of the heating medium.

As described above, when the flow rate of the heating medium is unevenly distributed in the heating medium channel of each of the plurality of layers, there are problems in that performance of heat exchange between the heating medium and a combustion gas is degraded, and noise and foreign materials are generated in a region where the flow rate of the heating medium is low, due to boiling of the heating medium resulting from local overheating.

DISCLOSURE

Technical Problem

The present invention is directed to providing a heat exchanger capable of improving heat exchange efficiency by allowing a flow rate of a heating medium passing through heating medium channels, which are formed in multiple layers between a plurality of plates, to be evenly distributed.

Technical Solution

One aspect of the present invention provides a heat exchanger including a heating medium channel (P1) formed in a space between a pair of plates facing each other and through which a heating medium flows, a combustion gas channel (P2) formed at an outer side of the heating medium channel (P1) and through which a combustion gas combusted in a burner flows, and heating medium dispersion portions (123 and 153) in which opened portions (123' and 153') and blocked portions (123" and 153") are formed at an inlet portion through which the heating medium flows into the heating medium channel (P1) or an outlet portion through which the heating medium flows out from the heating medium channel (P1).

Advantageous Effects

In accordance with a heat exchanger of the present invention, a heating medium dispersion portion in which an opened portion and a blocked portion are formed at an inlet portion through which a heating medium flows into a heating medium channel or an outlet portion through which the heating medium flows out from the heating medium channel is provided, so that a flow rate of the heating medium passing through the heating medium channels formed in multiple layers between a plurality of plates can be evenly distributed, and thus heat exchange efficiency can be improved.

Further, a flow direction of the heating medium circulating along a circumference of a combustion chamber is formed in one direction, and thus circulation of the heating medium is smoothly performed, and thus a pressure drop of the heating medium is minimized and local overheating is prevented, such that the heat exchange efficiency can be improved.

Furthermore, a stepped level is formed on a surface of each of a protruding portion and a recessed portion, and protrusions are configured to be brought into contact with each other at corresponding positions in a heating medium channel and a combustion gas channel, so that generation of turbulent flows of the heating medium and the combustion gas is induced such that the heat exchange efficiency can be improved and, at the same time, deformation of the plurality of plates due to a pressure of fluid can be prevented and pressure resistance performance can be improved.

DESCRIPTION OF DRAWINGS

FIG. 9 is a partial perspective view for describing an action of a heating medium dispersion portion.

FIG. 10 is a cross sectional view taken along the line C-C of FIG. 2 for describing an action of a heating medium distribution portion.

FIG. 11 is a cross-sectional perspective view taken along the line D-D in FIG. 2.

FIG. 12 is a cross-sectional perspective view taken along the line E-E in FIG. 2.

Description of Reference Numerals

Figure 1:
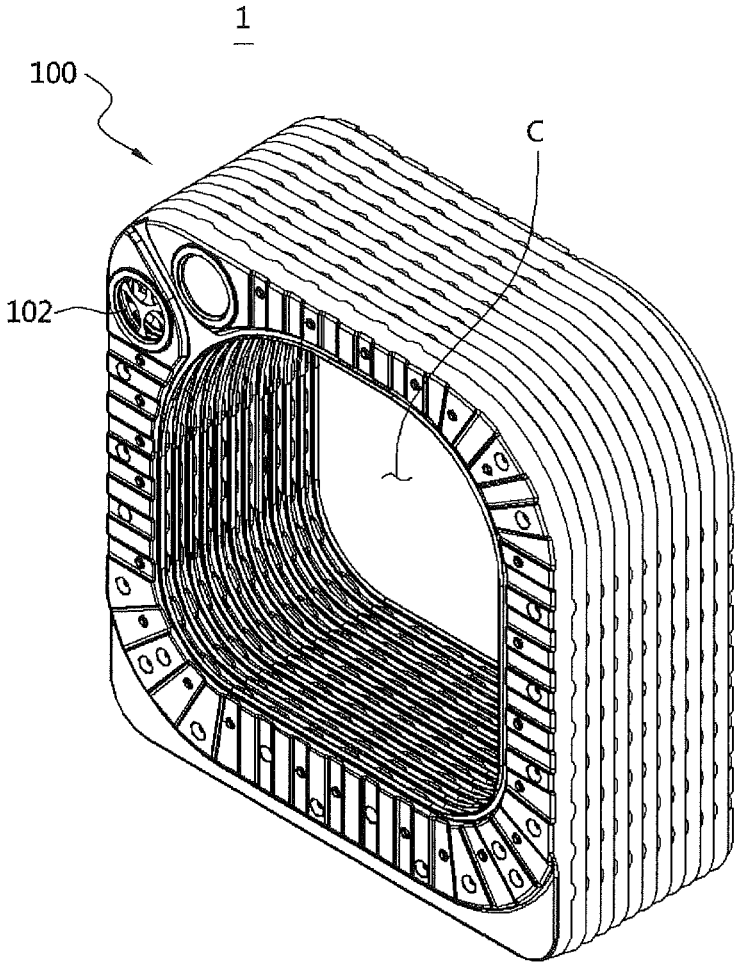
FIG. 1 is a perspective view of a heat exchanger according to one embodiment of the present invention.
Figure 2:
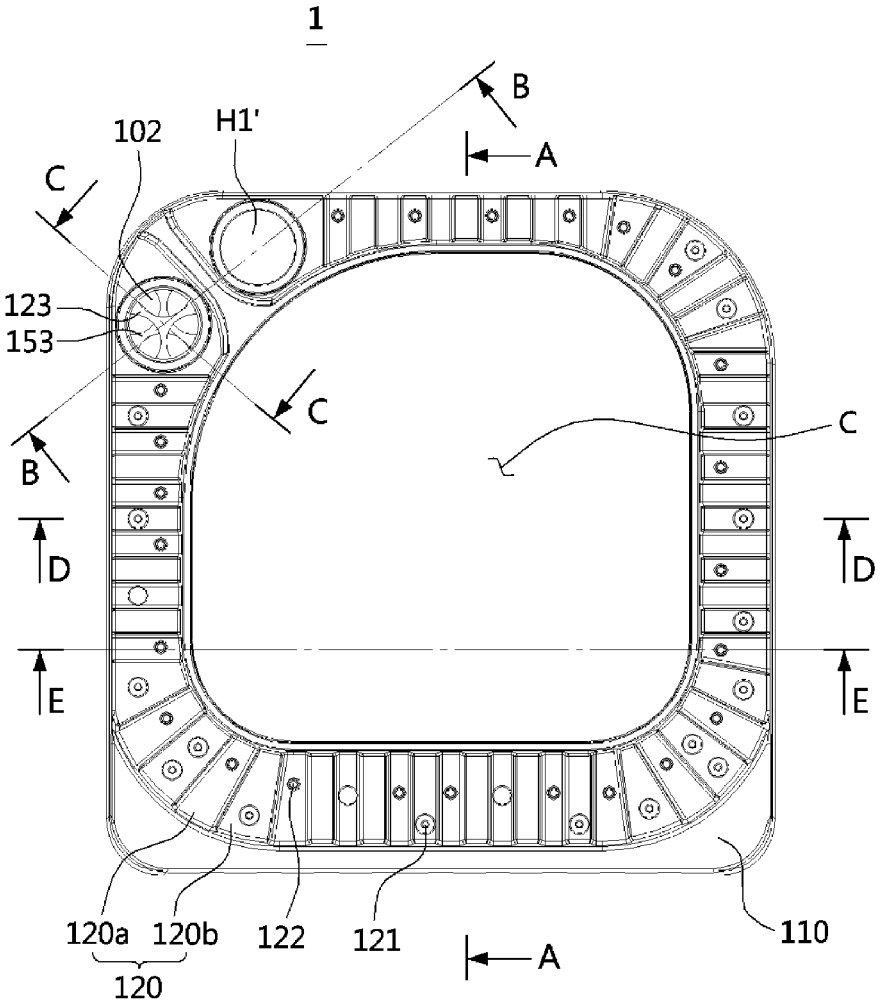
FIG. 2 is a front view of the heat exchanger according to one embodiment of the present invention.

| | |
|---|---|
| 1: heat exchanger | 100: heat exchange part |
| 100-1 to 100-12: unit plates | 100a-1 to 100a-12: first plates |
| 100b-1 to 100b-12: second plates | 100-a: first heat exchange part |
| 100-B: second heat exchange part | 100-C: third heat exchange part |
| 101: heating medium inlet | 102: heating medium outlet |
| 110: first flat surface | 120: protruding portion |
| 120a: first protruding piece | 120b: second protruding piece |
| 121: first protrusion | 122: second protrusion |
| 123: first heating medium dispersion portion | |
| 123': opened portion | 123": blocked portion |
| 124: first heating medium distribution portion | |
| 130: first flange | 131: first incised portion |
| 140: second flat surface | 150: recessed portion |
| 150a: first recessed piece | 150b: second recessed piece |
| 151: third protrusion | 152: fourth protrusion |
| 153: second heating medium dispersion portion | |
| 153': opened portion | 153": blocked portion |
| 154: second heating medium distribution portion | |
| 160: second flange | 161: second incised portion |
| A1: first opening | A2: second opening |
| H1 to H4: through-holes | H1' and H3': first blocked portions |
| H2' and H4': second blocked portions | P1: heating medium channel |
| P2: combustion gas channel | |

MODES OF THE INVENTION

Hereinafter, configurations and operations for preferred embodiments of the present invention will be described in detail with reference to the accompanying drawings.

Referring to FIGS. 1 to 7, a heat exchanger 1 according to one embodiment of the present invention includes a heat exchange part 100 configured with a plurality of plates stacked at a circumference of a combustion chamber C in which combustion heat and a combustion gas are generated by combustion of a burner (not shown).

The heat exchange part 100 may have a structure in which a plurality of plates are to be upright along a longitudinal direction and are stacked from a front side to a rear side, and a plurality of heat exchange parts 100-A, 100-B, and 100-C are stacked. Therefore, the burner may be assembled by being horizontally inserted into the combustion chamber C from the front side, and thus convenience in attachment or detachment of the burner and in maintenance of the heat exchanger 1 may be improved.

For example, the plurality of plates may be configured with first to twelfth unit plates 100-1, 100-2, 100-3, 100-4, 100-5, 100-6, 100-7, 100-8, 100-9, 100-10, 100-11, and 100-12, and the first to twelfth unit plates 100-1, 100-2, 100-3, 100-4, 100-5, 100-6, 100-7, 100-8, 100-9, 100-10, 100-11, and 100-12 are configured with first plates 100*a*-1, 100*a*-2, 100*a*-3, 100*a*-4, 100*a*-5, 100*a*-6, 100*a*-7, 100*a*-8, 100*a*-9, 100*a*-10, 100*a*-11, and 100*a*-12, respectively, which are disposed at front positions of the first to twelfth unit plates 100-1, 100-2, 100-3, 100-4, 100-5, 100-6, 100-7, 100-8, 100-9, 100-10, 100-11, and 100-12, and second plates 100*b*-1, 100*b*-2, 100*b*-3, 100*b*-4, 100*b*-5, 100*b*-6, 100*b*-7, 100*b*-8, 100*b*-9, 100*b*-10, 100*b*-11, and 100*b*-12, which are stacked in rear of the first plates 100*a*-1, 100*a*-2, 100*a*-3, 100*a*-4, 100*a*-5, 100*a*-6, 100*a*-7, 100*a*-8, 100*a*-9, 100*a*-10, 100*a*-11, and 100*a*-12, respectively.

A heating medium channel P1, through which a heating medium flows, is formed between a first plate and a second plate constituting each unit plate, and a combustion gas channel P2, through which a combustion gas flows, is formed between a second plate constituting one unit plate, which is disposed at one side, among adjacently stacked unit plates and a first plate constituting another unit plate, which is disposed at the other side, thereamong. The heating medium channel P1 and the combustion gas channel P2 are alternately formed adjacent to each other between the plurality of plates to allow heat exchange between the heating medium and the combustion gas.

Figure 3:
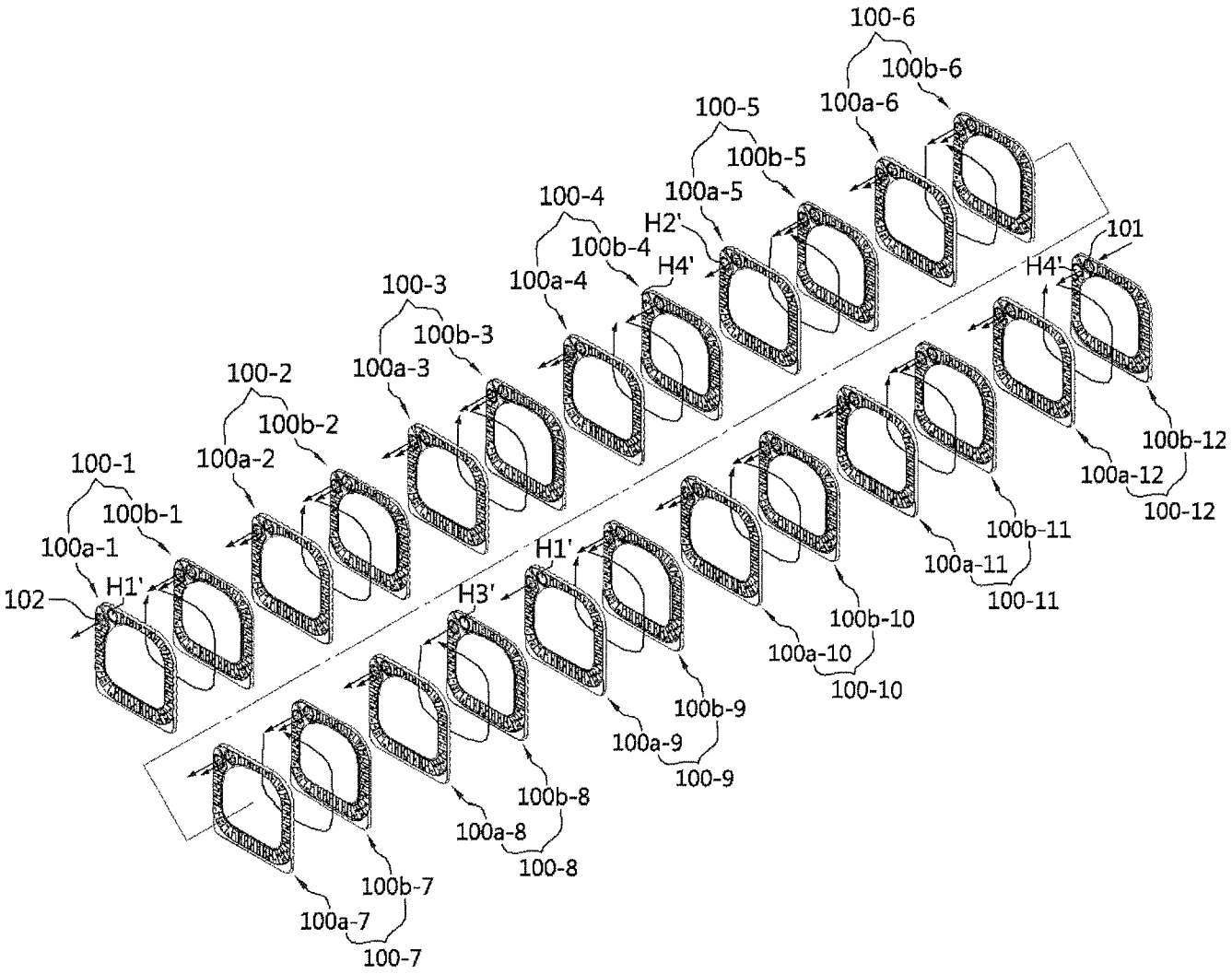
FIG. 3 is an exploded perspective view of the heat exchanger according to one embodiment of the present invention.
Figure 4:
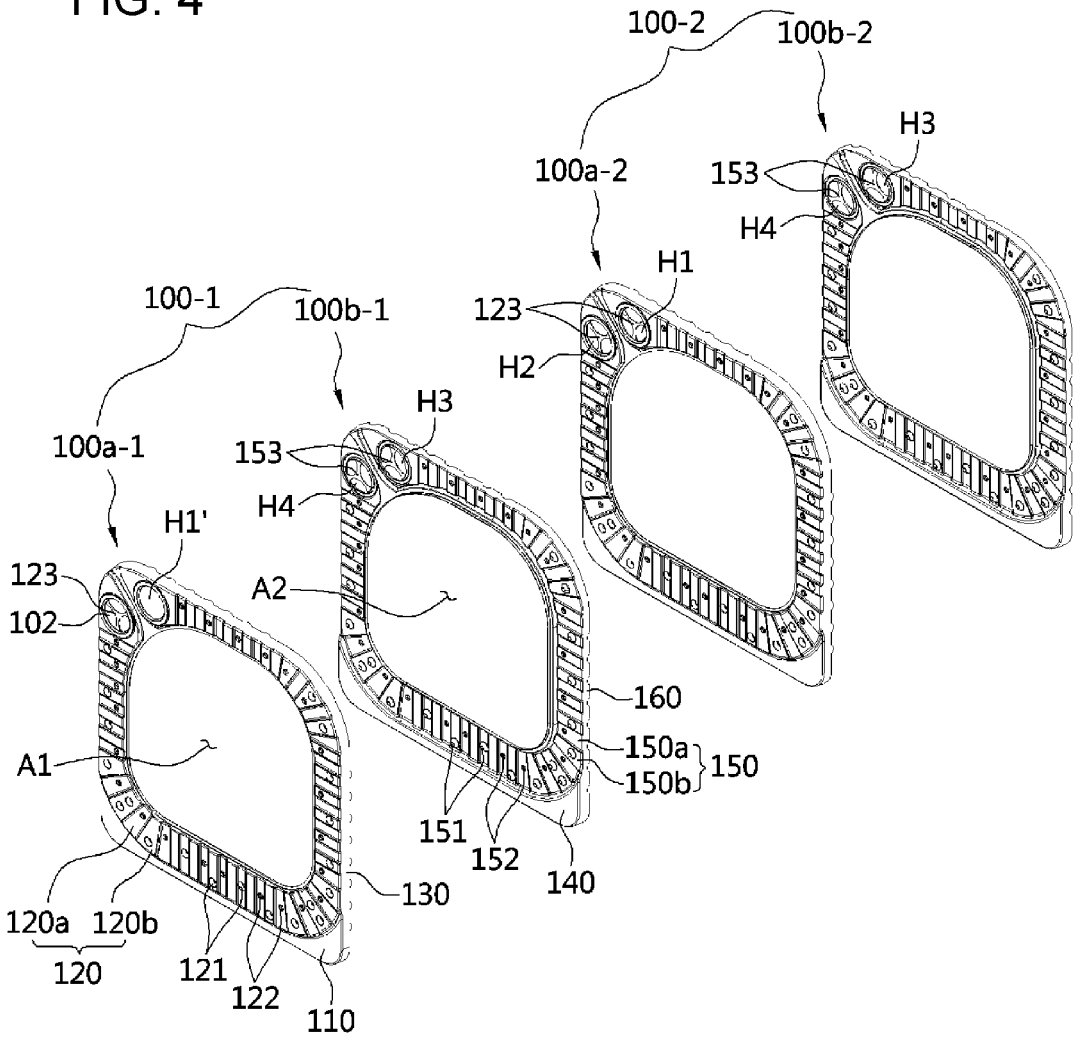
FIG. 4 is an enlarged perspective view of some unit plates shown in FIG. 3.
Figure 5:
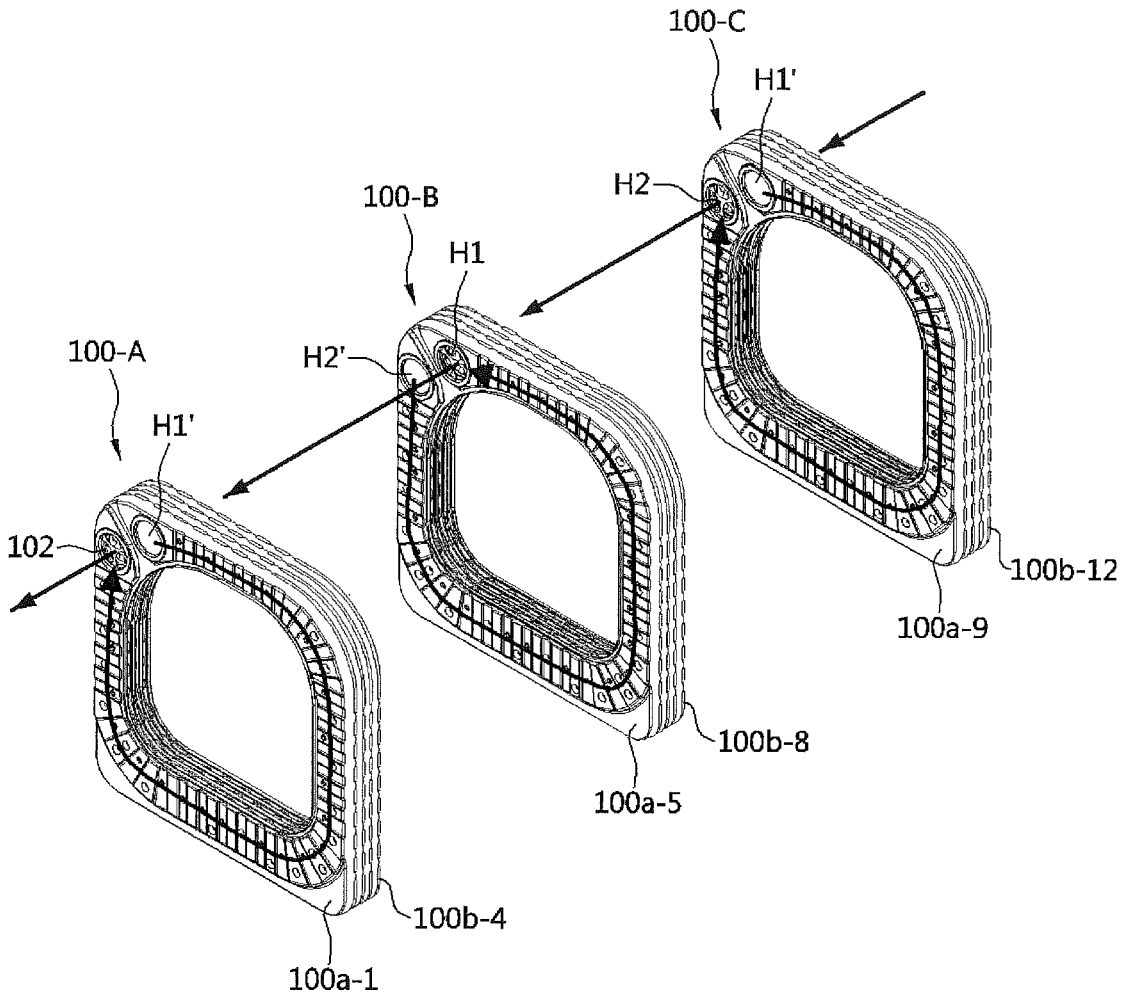
FIG. 5 is a perspective view illustrating a flow path of a heating medium.

Referring to FIGS. 3 to 5, the first plate includes a first flat surface 110 having a first opening A1 formed at a central portion thereof, a protruding portion 120 formed to protrude from the first flat surface 110 to the front side and having sections being communicated in a circumferential direction, and a first flange 130 extending from an edge of the first flat surface 110 to the rear side.

The second plate includes a second flat surface 140 having a second opening A2 formed at a central portion thereof to correspond to the first opening A1 in front and rear directions and configured to be brought into contact with the first flat surface 110, a recessed portion 150 formed to protrude from the second flat surface 140 to the rear side, having sections being communicated in a circumferential direction, and configured to form the heating medium channel P1 between the protruding portion 120 and the recessed portion 150, and a second flange 160 extending from an edge of the second flat surface 140 to the rear side and configured to be coupled to a first flange 130 of a unit plate disposed next to the second plate.

In FIGS. 3 and 5, arrows indicate flow directions of the heating medium.

Referring to FIG. 5, the heat exchange part 100 is configured in a structure in which a plurality of heat exchange parts are stacked, and, for example, the heat exchange part 100 may be configured with first heat exchange part 100-A, a second heat exchange part 100-B, and a third heat exchange part 100-C. The heating medium channel P1 in the plurality of heat exchange parts 100-A, 100-B, and 100-C is configured such that a flow direction of the heating medium is only formed in one direction. That is, a flow direction of a heating medium in each of the plurality of heat exchange parts 100-A, 100-B, and 100-C is directed in one direction, but flow directions of heating media in adjacent heat exchange parts among the plurality of heat exchange units 100-A, 100-B, and 100-C are formed in series and directed in opposite directions (a clockwise direction and a counterclockwise direction). Further, the heating medium channels P1 are formed in parallel at a plurality of unit plates constituting each of the heat exchange parts 100-A, 100-B, and 100-C.

A configuration for a unidirectional flow of the heating medium will be described below.

Referring to FIGS. 3 and 4, the first through-hole H1 and the second through-hole H2 are formed adjacent to each other at one side of an upper portion of the first plate, and the third through-hole H3 corresponding to the first through-hole H1 and the fourth through-hole H4 corresponding to the second through-hole H2 are formed at one side of an upper portion of the second plate.

At one side of an upper portion of the first plate 100*a*-1 disposed a foremost position, a first blocked portion H1' is formed at a position corresponding to the first through-hole H1, and the heating medium outlet 102 is formed at a position corresponding to the second through-hole H2.

At one side of an upper portion of the second plate 100*b*-12 disposed at a rearmost position, the heating medium inlet 101 is formed at a position corresponding to the third through-hole H3, and a fourth blocked portion H4' is formed at a position corresponding to the fourth through-hole H4.

Further, the fourth blocked portion H4' is formed at a position, corresponding to the fourth through-hole H4 on the second plate 100*b*-4 of the fourth unit plate 100-4, a second blocked portion H2' is formed at a position corresponding to the second through-hole H2 on the first plate 100*a*-5 of the fifth unit plate 100-5, a third blocked portion H3' is formed at a position corresponding to the third through-hole H3 on the second plate 100*b*-8 of the eighth unit plate 100-8, and the first blocked portion H1' is formed at a position corresponding to the first through-hole H1 on the first plate 100*a*-9 of the ninth plate 100-9.

Therefore, a heating medium flowing into the heating medium channel P1 of the twelfth unit plate 100-12 through the heating medium inlet 101 formed in the second plate 100*b*-12 of the twelfth unit plate 100-12 disposed at the rearmost position flows to the front side through the first to fourth through-holes H1, H2, H3, and H4 formed in the twelfth to ninth unit plates 100-12, 100-11, 100-10, and 100-9, and at the same time, since the first blocked portion H1' is formed at the first plate 100*a*-9 of the nine unit plate 100-9, the heating medium flows in a clockwise direction in the heating medium channels P1 inside the twelfth to ninth unit plates 100-12, 100-11, 100-10, and 100-9.

Further, the heating medium flowing into the heating medium channel P1 of the eighth unit plate 100-8 through the second through-hole H2 formed in the first plate 100*a*-9 of the ninth unit plate 100-9 and the fourth through-hole H4 formed in the second plate 100*b*-8 of the eighth unit plate 100-8 flows to the front side through the first to fourth through-holes H1, H2, H3, and H4 formed in the eighth to fifth unit plates 100-8, 100-7, 100-6, and 100-5, and at the same time, since the second blocked portion H2' is formed at the first plate 100*a*-5 of the fifth unit plate 100-5, the heating medium flows in a counterclockwise direction in the heating medium channels P1 inside the eighth to fifth unit plates 100-8, 100-7, 100-6, and 100-5.

Furthermore, the heating medium flowing into the heating medium channel P1 of the fourth unit plate 100-4 through the first through-hole H1 formed in the first plate 100*a*-5 of the fifth unit plate 100-5 and the third through-hole H3 formed in the second plate 100*b*-4 of the fourth unit plate 100-4 flows to the front side through the first to fourth through-holes H1, H2, H3, and H4 formed in the fourth to first unit plates 100-4, 100-3, 100-2, and 100-1, and at the same time, since the first blocked portion H1' is formed at the first plate 100*a*-1 of the first unit plate 100-1, the heating medium flows in the clockwise direction in the heating medium channels P1 inside the fourth to first unit plates 100-4, 100-3, 100-2, and 100-1.

As described above, in the structure in which the heat exchange part 100 is formed to be upright along a longitudinal direction, heating medium connection channels configured with the heating medium channels P1 and the first to fourth through-holes H1, H2, H3, and H4 are formed to allow the heating medium to flow in one direction, so that the heating medium flowing along the circumference of the combustion chamber C circulates smoothly, such that a pressure drop of the heating medium is minimized and local overheating thereof is prevented, thus improving thermal efficiency.

Further, a capacity of the heat exchanger may be increased without a pressure drop by adjusting the number of parallel channels in each of the heat exchange parts 100-A, 100-B, and 100-C when the capacity of the heat exchanger is increased.

Figure 6:
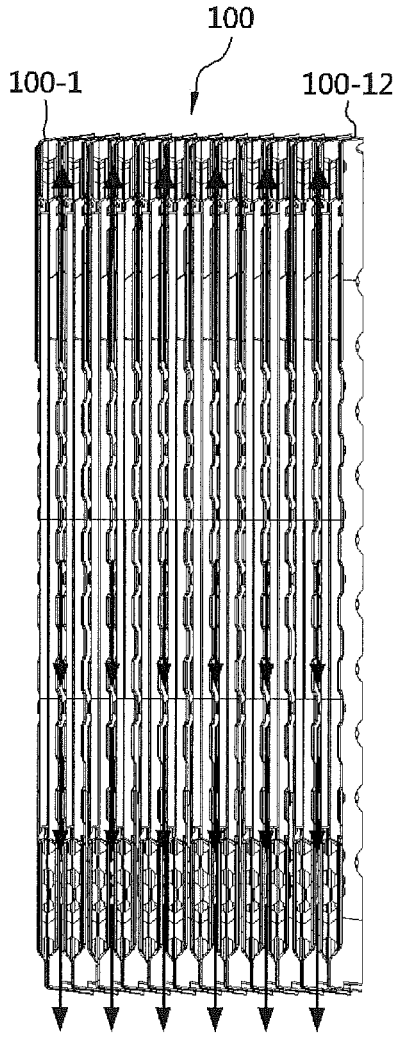
FIG. 6 is a cross-sectional view taken along the line A-A of FIG. 2.
Figure 7:
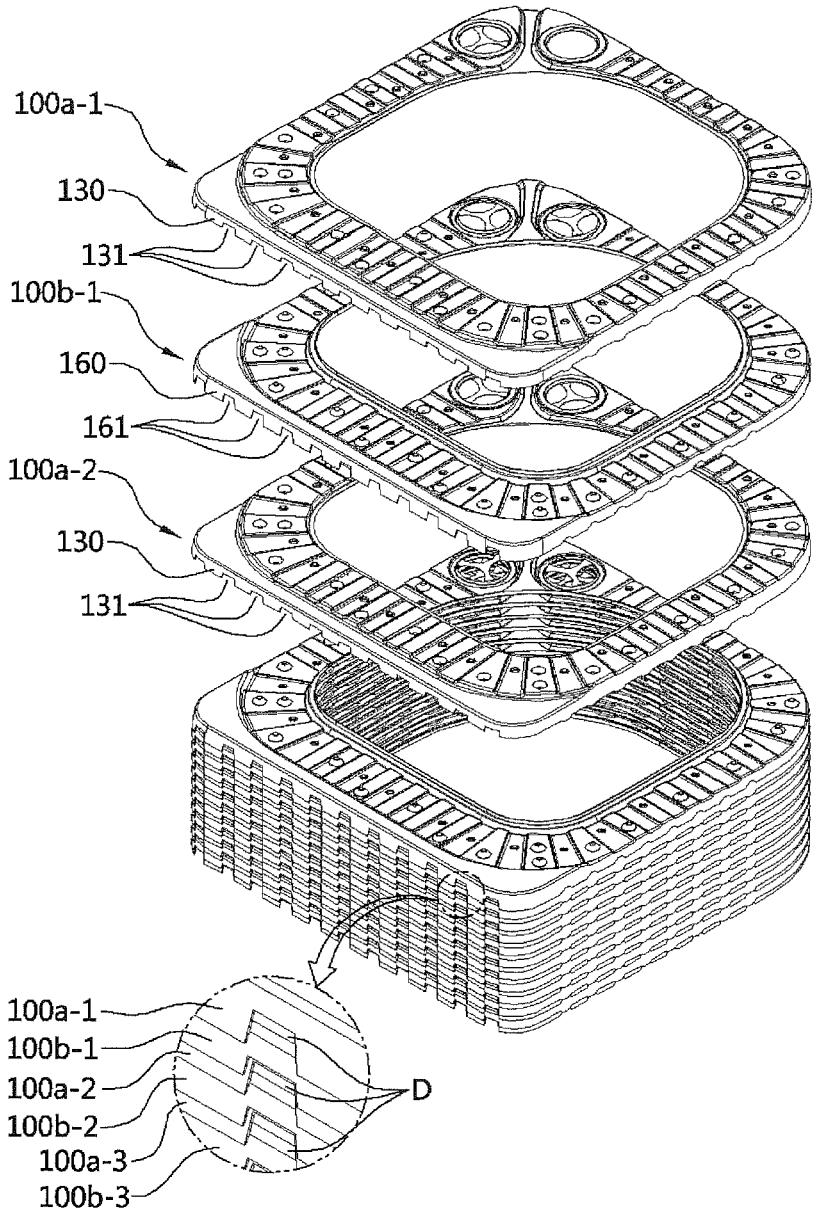
FIG. 7 is a partially exploded perspective view illustrating a state in which a combustion gas pass-through portion is formed at a lower portion of the heat exchanger.

Referring to FIGS. 6 and 7, the combustion gas generated by combustion of the burner in the combustion chamber C is discharged downward through the lower portion of the heat exchange part 100.

As a configuration for allowing the combustion gas to be smoothly discharged by passing through the combustion gas channels P2, when the first and second plates are stacked, the first flange 130 of the first plate and the second flange 160 of the second plate are partially overlapped with each other, and the combustion gas pass-through portion D through which the combustion gas, which is flowing by passing through the combustion gas channels P2, is discharged is formed at some region of the edges of the first plate and the second plate.

A plurality of first incised portions 131 are formed at a combustion gas discharge side of the first flange 130, a plurality of second incised portions 161 are formed at a combustion gas discharge side of the second flange 160, and when the first plate and the second plate are stacked, the combustion gas pass-through portion D is formed at some regions of the first incised portion 131 and the second incised portion 161.

A plurality of combustion gas pass-through portions D are formed to be spaced apart from each other in lateral and longitudinal directions at the lower portion of the heat exchange part 100, and thus the combustion gas passing through the heat exchange part 100 may be distributed and discharged at a uniform flow rate across an entire region of the lower portion of the heat exchange part 100, such that flow resistance of the discharged combustion gas is reduced and noise and vibration are prevented.

Meanwhile, in a section where the flow direction of the heating medium is switched in the heat exchange parts 100-A, 100-B, and 100-C, that is, a section connected from the third heat exchange part 100-C to the second heat exchange part 100-B, or a section connected from the second heat exchange part 100-B to the first heat exchange part 100-A, a flow rate of the heating medium flowing to the heating medium channel P1 formed in each of the heat exchange parts 100-A, 100-B, and 100-C may tend to be unevenly distributed by inertia and pressure.

As described above, when a flow rate is unevenly distributed to the heating medium channels P1, there are problems in that performance of heat exchange is degraded, and noise and foreign materials are generated due to boiling of the heating medium caused by local overheating in a region where the flow rate is low.

Figure 8:
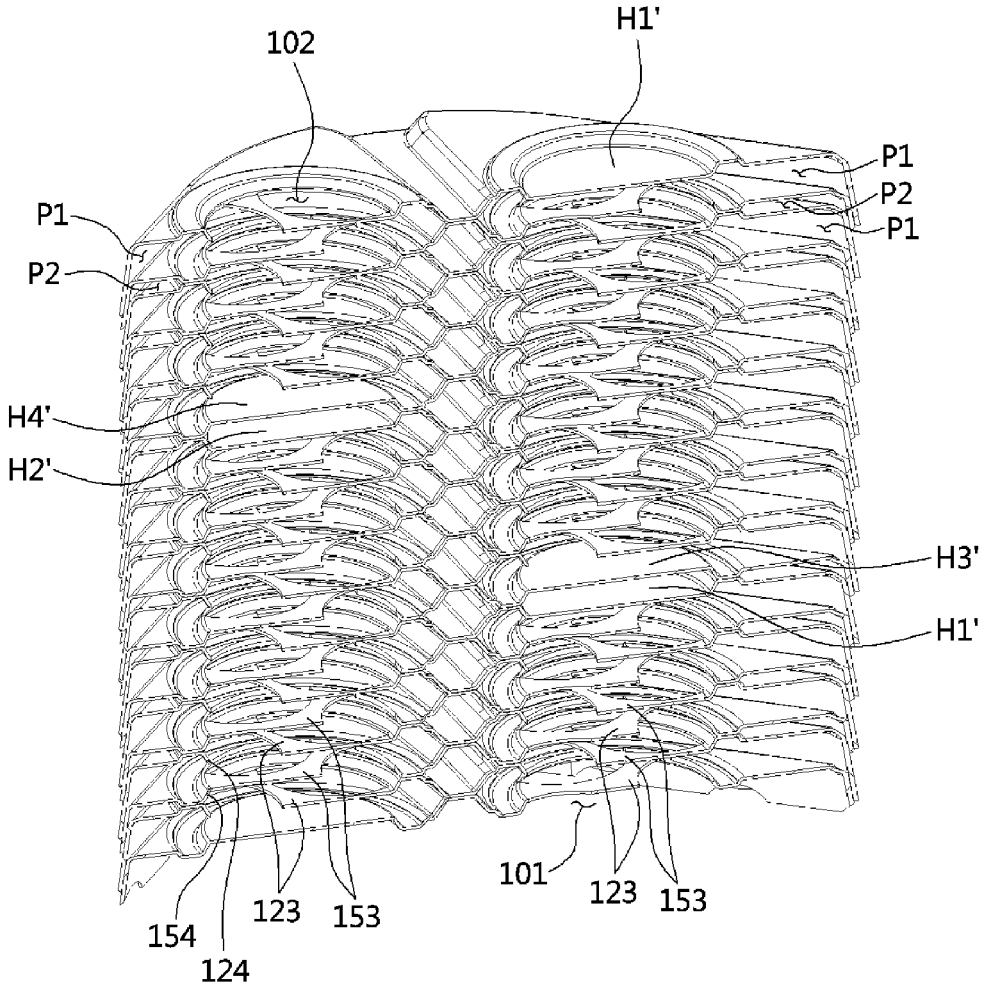
FIG. 8 is a cross-sectional perspective view taken along the line B-B in FIG. 2.

As a part for resolving the problem of non-uniform distribution in flow rate of the heating medium, as shown in FIGS. 8 and 9, heating medium dispersion portions 123 and 153 at which opened portions 123' and 153' and blocked portions 123" and 153" are formed are provided at inlet parts through which the heating medium flows into the heating medium channel P1 or outlet parts through which the heating medium flows out from the heating medium channel P1.

A plurality of heating medium dispersion portions 123 and 153 are provided to be spaced apart in the flow direction of the heating medium, and the opened portions 123' and 153' and the blocked portions 123" and 153" are provided to intersect with each other along the flow direction of the heating medium between adjacently disposed heating medium dispersion portions 123 and 153.

The opened portions 123' and 153' and the blocked portions 123" and 153" are alternately formed in the heating medium dispersion portions 123 and 153 in a circumferential direction thereof.

Thus, as indicated by arrows in FIG. 9, the heating medium having passed through a first opened portion 123' formed at the first heating medium dispersion portion 123 is dispersed by colliding with a second blocked portion 153" of the second heating medium dispersion portion 153 located behind the first opened portion 123', and the heating medium having passed through a second opened portion 153' formed at the second heating medium dispersion portion 153 is dispersed by colliding with the first blocked portion 123" of the first heating medium dispersion portion 123 located behind the second opened portion 153', and inertia of the heating medium is alleviated by such a dispersion action, so that a flow rate of the heating medium flowing to the heating medium channel P1 of each layer may be evenly adjusted.

As another part for resolving the problem of non-uniform distribution in flow rate of the heating medium, as shown in FIGS. 8 and 10, heating medium distribution portions 124 and 154 are provided at portions of the heating medium channel P1 where the flow direction of the heating medium is switched, thereby narrowing the heating medium channel P1.

The heating medium distribution portions 124 and 154 may be formed in embossed shapes protruding toward the heating medium channel P1 at portions where the heating medium flows into and out from the heating medium channel P1.

Therefore, a cross-sectional area of a channel formed between a first heating medium distribution portion 124 formed at the first plate and a second heating medium distribution portion 154 formed at the second plate is formed to be smaller than a cross-sectional area of the heating medium channel P1 formed between the first plate and the second plate, and thus a phenomenon in which the heating medium is intensively flowed into some of the heating medium channels P1 of layers may be prevented, so that a flow rate of the heating medium flowing through the heating medium channel P1 of each layer may be evenly adjusted.

Meanwhile, referring to FIG. 4, the protruding portion 120 formed at the first plate is configured such that a first protruding piece 120*a* and a second protruding piece 120*b* having different heights in a front-rear direction are alternately disposed along a circumferential direction, and the recessed portion 150 formed at the second plate is configured such that a first recessed piece 150*a* and a second recessed piece 150*b* having different heights in the front-rear direction are alternately disposed along the circumferential direction. As described above, a stepped level is formed at each of the protruding portion 120 and the recessed portion 150, so that efficiency of heat exchange may be improved by inducing a turbulent flow to be actively generated in the flows of the heating medium and the combustion gas.

Referring to FIG. 11, a plurality of first protrusions 121 protruding toward the heating medium channel P1 are formed in the protruding portion 120, and a plurality of third protrusions 151 protruding toward the heating medium channel P1 and being brought into contact with the plurality of first protrusions 121 are formed in the recessed portion 150. Further, referring to FIG. 12, a plurality of second protrusions 122 protruding toward the combustion gas channel P2 are formed in the protruding portion 120, and a plurality of fourth protrusions 152 protruded toward the combustion gas channel P2 and being brought into contact with the plurality of second protrusions 122 are formed in the recessed portion 150. Thus, the first protrusion 121 and the third protrusion 151 protrude inward the heating medium channel P1 and are brought into contact with each other, and the second protrusion 122 and the fourth protrusion 152 protrude inward the combustion gas channel P2 and are brought into contact with each other so that efficiency of heat exchange may be improved by inducing a turbulent flow to be generated in the flows of the heating medium and the combustion gas, and at the same time, deformation of the plates due to a pressure of fluid may be prevented and pressure resistance performance may be improved.

The invention claimed is:

1. A heat exchanger comprising:

a plurality of heating medium channels (P1) formed in a space between a pair of plates facing each other and through which a heating medium flows;

a plurality of combustion gas channels (P2) formed at an outer side of the plurality of heating medium channels (P1) and through which a combustion gas combusted in a burner flows;

a plurality of heating medium dispersion portions (123 and 153) in which opened portions (123' and 153') and blocked portions (123" and 153") are formed at an inlet portion through which the heating medium flows into the plurality of heating medium channels (P1) or an outlet portion through which the heating medium flows out from the plurality of heating medium channels (P1); and a heat exchange part in which the plurality of heating medium channels (P1) and the plurality of combustion gas channels (P2) are alternately formed adjacent to each other in a space between a plurality of plates, wherein the heat exchange part is configured to surround an outer side of a combustion chamber (C) provided at a central portion of the heat exchange part, and a plurality of the heat exchange part is provided in a stacked structure; and the plurality of heating medium dispersion portions (123 and 153) are provided at a channel in which the flow direction of the heating medium is switched in the plurality of heat exchange parts.

2. The heat exchanger of claim 1, wherein:

the plurality of heating medium dispersion portions (123 and 153) are provided and spaced apart from each other along a flow direction of the heating medium; and the opened portions (123' and 153') and the blocked portions (123" and 153") are provided to intersect with each other along the flow direction of the heating medium between adjacently disposed the plurality of heating medium dispersion portions (123 and 153).

3. The heat exchanger of claim 1, wherein the opened portions (123' and 153') and the blocked portions (123" and 153") are alternately formed at the plurality of heating medium dispersion portions (123 and 153) in a circumferential direction thereof.

4. The heat exchanger of claim 1, wherein each of the plurality of heating medium channels (P1) is formed to direct a flow of the heating medium in one direction, and the plurality of heating medium channels (P1) of adjacently disposed heat exchange parts among the plurality of heat exchange parts are formed in series to direct flows of the heating medium in opposite directions.

5. The heat exchanger of claim 4, wherein the plurality of heating medium channels (P1) are formed in parallel inside each of the plurality of heat exchange parts.

6. The heat exchanger of claim 1, wherein:

the plurality of plates are formed by stacking a plurality of unit plates, wherein a first plate and a second plate are stacked in each of the plurality of unit plates;

a first flat surface (110) having a first opening (A1) formed at a central portion thereof, a protruding portion (120) formed to protrude from the first flat surface (110) to a front side and having sections being communicated in a circumferential direction, and a first flange (130) extending from an edge of the first flat surface (110) to a rear side are formed on the first plate; and a second flat surface (140) having a second opening (A2) formed at a central portion thereof to correspond to the first opening (A1) in the front-rear direction and configured to be brought into contact with the first flat surface (110), a recessed portion (150) formed to protrude from the second flat surface (140) to a rear side, having sections being communicated in a circumferential direction, and configured to form the plurality of heating medium channels (P1) between the protruding portion (120) and the recessed portion (150), and a second flange (160) extending from an edge of the second flat surface (140) to the rear side and configured to be coupled to the first flange (130) of a unit plate disposed next to the second plate are formed on the second plate.

7. The heat exchanger of claim 6, wherein:

through-holes (H1 and H3) at one side and through-holes (H2 and H4) at the other side for providing a heating medium connection channel to allow the heating medium to flow in one direction between adjacently stacked heat exchange parts;

first blocked portions (H1' and H3') for inducing the heating medium flowing into the plurality of heating medium channels (P1) through the through-holes (H1 and H3) at the one side to flow to the through-holes (H2 and H4) at the other side via a circumference of the combustion chamber (C) in one direction; and second blocked portions (H2' and H4') for inducing the heating medium flowing into the plurality of heating medium channel (P1) through the through-holes (H2 and H4) at the other side to flow to the through-holes (H1 and H3) at the one side via the circumference of the combustion chamber (C) in an opposite direction are formed at one side portion of the heat exchange part.

8. The heat exchanger of claim 7, wherein the plurality of heating medium dispersion portions (123 and 153) are provided at each of the through-holes (H1 and H3) at the one side and the through-holes (H2 and H4) at the other side.

9. The heat exchanger of claim 6, wherein:

the protruding portion (120) is configured with a first protruding piece (120*a*) and a second protruding piece (120*b*), which are alternately disposed along a circumferential direction and have different heights in the front-rear direction; and the recessed portion (150) is configured with a first recessed piece (150*a*) and a second recessed piece (150*b*), which are alternately disposed along the circumferential direction and have different heights in the front-rear direction.

10. The heat exchanger of claim 6, wherein:

a plurality of protrusions (121) protruding toward the plurality of heating medium channels (P1) are formed at the protruding portion (120); and a plurality of protrusions (151) protruding toward the plurality of heating medium channels (P1) and being brought into contact with the plurality of protrusions (121) are formed at the recessed portion (150).

11. The heat exchanger of claim 6, wherein:

a plurality of protrusions (122) protruding toward the plurality of combustion gas channels (P2) are formed at the protruding portion (120); and a plurality of protrusions (152) protruding toward the plurality of combustion gas channels (P2) and being brought into contact with the plurality of protrusions (122) are formed at the recessed portion (150).

* * * * *